US006827145B2

(12) United States Patent
Fotland et al.

(10) Patent No.: US 6,827,145 B2
(45) Date of Patent: Dec. 7, 2004

(54) METHODS AND APPARATUS FOR SEVERING NESTED STRINGS OF TUBULARS

(75) Inventors: Per Fotland, Hundvaag (NO); Tor Jan Akerlund, Forus (NO)

(73) Assignee: Weatherford/Lamb, Inc., Houston, TX (US)

( * ) Notice: Subject to any disclaimer, the term of this patent is extended or adjusted under 35 U.S.C. 154(b) by 44 days.

(21) Appl. No.: 10/101,497

(22) Filed: Mar. 19, 2002

(65) Prior Publication Data

US 2003/0015322 A1 Jan. 23, 2003

Related U.S. Application Data

(63) Continuation-in-part of application No. 09/355,439, filed as application No. PCT/GB97/03174 on Nov. 19, 1997, now Pat. No. 6,412,553.

(60) Provisional application No. 60/277,439, filed on Mar. 20, 2001.

(30) Foreign Application Priority Data

Jan. 29, 1997 (GB) ..... 9701790

(51) Int. Cl.[7] ..... E21B 29/08; E21B 19/16

(52) U.S. Cl. ..... 166/298; 166/55.2; 166/86.3; 166/377

(58) Field of Search ..... 166/250.01, 255.1, 166/255.2, 297, 301, 376, 377, 381, 55, 55.2, 77.51, 86.3, 298

(56) References Cited

U.S. PATENT DOCUMENTS

| | | | | |
|---|---|---|---|---|
| 2,668,689 A | | 2/1954 | Cormany | 255/35 |
| 2,692,059 A | | 10/1954 | Bolling, Jr. | 214/2.5 |
| 3,253,336 A | * | 5/1966 | Brown | 30/98 |
| 3,392,609 A | | 7/1968 | Bartos | 81/57 |
| 3,518,903 A | | 7/1970 | Ham et al. | 81/57.16 |
| 3,561,526 A | * | 2/1971 | Williams et al. | 166/55 |
| 3,603,387 A | * | 9/1971 | Schoeffler | 166/55 |
| 3,766,979 A | * | 10/1973 | Petrick | 166/55 |
| 3,838,613 A | | 10/1974 | Wilms | 81/57.34 |
| 3,839,791 A | * | 10/1974 | Feamster, III | 30/97 |

(List continued on next page.)

FOREIGN PATENT DOCUMENTS

| | | | |
|---|---|---|---|
| EP | 0 778 392 A2 | 6/1997 | E21B/29/12 |
| FR | 2 053 088 | 10/1973 | B66C/23/36 |
| GB | 1 469 661 | 7/1974 | E21B/19/00 |
| GB | 2 201 912 | 9/1988 | |
| GB | 2 285 077 A | 6/1995 | E21B/29/12 |
| GB | 2 313 859 A | 12/1997 | E21B/29/12 |
| WO | WO 90/06418 | 6/1990 | E21B/19/16 |
| WO | WO 92/18743 | 10/1992 | E21B/19/16 |
| WO | WO 95/10686 | 4/1995 | E21B/19/14 |
| WO | WO 99/11902 | 3/1999 | E21B/19/20 |

OTHER PUBLICATIONS

International Search Report, International Application No. PCT/GB 02/01339, dated Nov. 6, 2002.

*Primary Examiner*—David Bagnell
*Assistant Examiner*—Jennifer H Gay
(74) *Attorney, Agent, or Firm*—Moser, Patterson & Sheridan, L.L.P.

(57) ABSTRACT

An apparatus and method for use in severing casing as it is pulled from a wellbore. An apparatus is first provided, comprising a clamping assembly, a drilling assembly and a cutting assembly. In one aspect, the apparatus is disposed at the end of a telescopic arm, with the components being remotely operated by personnel using a control panel. The apparatus can be positioned adjacent casing and clamped thereto. Thereafter, the apparatus can drill a hole completely through the casing for the insertion of a retention pin. The apparatus can then severe the casing into manageable lengths to facilitate disposal, such as during a plugging and abandonment procedure.

60 Claims, 6 Drawing Sheets

U.S. PATENT DOCUMENTS 3,840,128 A 10/1974 Swoboda, Jr. et al. ... 214/1 BD
3,863,667 A * 2/1975 Ward ..... 137/318
3,881,375 A 5/1975 Kelly ..... 81/57.35
3,885,679 A 5/1975 Swoboda Jr. et al. .... 214/1 BD
3,980,143 A 9/1976 Swartz et al. ..... 173/100
4,077,525 A 3/1978 Callegari et al. ..... 214/2.5
4,181,196 A 1/1980 Darby et al. ..... 166/361
4,194,383 A 3/1980 Huzyak ..... 72/245
4,227,197 A 10/1980 Nimmo et al. ..... 343/878
4,274,777 A 6/1981 Scaggs ..... 414/22
4,277,197 A 7/1981 Bingham ..... 403/104
4,440,220 A 4/1984 McArthur ..... 166/85
4,493,150 A * 1/1985 Garcia et al. ..... 30/97
4,557,628 A 12/1985 Cowan ..... 405/191
4,604,724 A 8/1986 Shaginian et al. ..... 364/478
4,652,195 A 3/1987 McArthur ..... 414/22
4,681,158 A 7/1987 Pennison ..... 166/77.5
4,686,873 A 8/1987 Lang et al. ..... 81/57.35
4,691,587 A 9/1987 Farrand et al. ..... 74/493
4,725,179 A 2/1988 Woolslayer et al. ..... 414/22
4,832,552 A 5/1989 Skelly ..... 414/22.54
4,843,945 A 7/1989 Dinsdale ..... 81/57.34
4,921,386 A 5/1990 McArthur ..... 414/22.51
5,049,020 A 9/1991 McArthur ..... 414/22.51
5,060,542 A 10/1991 Hauk ..... 81/57.34
5,176,518 A 1/1993 Hordijk et al. ..... 434/37
5,294,228 A 3/1994 Willis et al. ..... 414/22.55
5,354,150 A 10/1994 Canales ..... 405/154
5,368,113 A 11/1994 Schulze-Beckinghausen ..... 175/162
5,386,746 A 2/1995 Hauk ..... 81/57.34
5,509,440 A * 4/1996 Cantaloube et al. ..... 137/318
5,661,888 A 9/1997 Hanslik ..... 29/407.02
5,667,026 A 9/1997 Lorenz et al. ..... 175/162
5,711,382 A 1/1998 Hansen et al. ..... 175/52
5,907,664 A 5/1999 Wang et al. ..... 395/86
5,931,231 A 8/1999 Mock ..... 166/377
6,125,928 A * 10/2000 Ninivaara et al. ..... 166/55
6,131,597 A * 10/2000 Mendicino et al. ..... 137/15.14
6,408,944 B1 * 6/2002 Niinivaara et al. ..... 166/298
6,412,553 B1 7/2002 Akerlund ..... 166/77.51

* cited by examiner

METHODS AND APPARATUS FOR SEVERING NESTED STRINGS OF TUBULARS

CROSS-REFERENCE TO RELATED APPLICATIONS

This application claims priority to a pending provisional patent application entitled "Methods and Apparatus for Severing Concentric Strings of Tubulars," filed on Mar. 20, 2001. That application carries Prov. Ser. No. 60/277,439.

This application is also a continuation-in-part of U.S. patent application Ser. No. 09/355,439, filed Nov. 29, 1999, now U.S. Pat. No. 6,412,553. That application is entitled "Apparatus for Positioning a Tong, and Drilling Rig Provided with Such an Apparatus." The parent application was the National Stage of International Application No. PCT/GB97/03174, filed Nov. 19, 1997 and published under PCT Article 21(2) in English, and claims priority of United Kingdom Application No. 9701790.9 filed on Jan. 29, 1997. Each of the aforementioned related patent applications is herein incorporated in Its entirety by reference.

BACKGROUND OF THE INVENTION

Field of the Invention

The present invention generally relates to plugging and abandonment of oil and gas wells. More particularly, the present invention relates to the removal of a tubular from a wellbore in order to satisfy various environmental regulations. More particularly still, the invention relates to severing nested strings of tubulars that are cemented together in order to more easily handle the tubulars as they are removed from a wellbore during or subsequent to a plugging and abandonment operation.

In the completion of oil and gas wells, boreholes are formed in the earth and thereafter are lined with steel pipe known as casing. An annular area formed between the outside of the casing and the wall of the borehole is typically filled with cement in order to secure the casing in the borehole and to facilitate the isolation of certain areas of the wellbore for the collection of hydrocarbons. In most instances, because of the depth of a wellbore, concentric strings of tubulars are disposed in the wellbore with each lower string of tubulars being necessarily smaller in diameter than the previous string. In some cases, especially in offshore oil and gas wells, the strings are run in a nested fashion from the surface of the well. In other words, a first string of casing is cemented into the wellbore and, subsequently, a second smaller string of casing is cemented into the first string to permit the borehole to be lined to a greater depth. This process is typically repeated with additional casing strings until the well has been drilled to total depth. In this manner, wells are typically formed with two or more strings of casing of an ever-decreasing diameter.

When a decision is made to no longer operate a hydrocarbon well, the wellbore is typically plugged to prevent formation fluids from migrating towards the surface of the well or into a different zone. Various environmental laws and regulations govern the plugging and abandonment of wellbores. These regulations typically require that the wellbore be filled with some amount of cement. In some instances, the cement must be squeezed into the annular area around the cemented casing in order to prevent fluids from migrating up towards the surface of the well on the outside of the casing through any cement gaps. In offshore wells, regulations typically require not only the foregoing steps, but also that a certain amount of wellbore casing be completely removed from the wellbore. For example, in some instances, the upper 1,000 feet of casing extending downward from the ocean floor into the wellbore must be removed to complete a plugging and abandonment operation.

Various methods and techniques have been developed and are currently utilized in order to remove casing from an offshore wellbore. Most often, some type of cutting device is run into the wellbore on a wireline or string of tubulars. The cutting device is actuated in order to sever the casing at a predetermined depth, creating separate upper and lower strings of casing. Thereafter, the upper string is pulled and brought to the surface.

Because of the great length and weight of the upper string of casing being removed, it is necessary to further sever the upper casing string as it is retrieved at the surface. Accordingly, the casing is further severed into predetermined lengths. This makes handling and disposal of the removed casing more efficient.

In some instances, the severed upper string of casing includes more than one set of tubulars. In other words, there is a first outer string of casing, and then a second smaller string of casing nested therein. In one example, the outer casing string is 13⅜ inches in diameter, and the smaller casing nested therein is 9⅝ inches in diameter. These two strings of severed casing will typically be joined by a layer of cement within the annular area. This cement layer adds to the weight of the severed casing string, making it even more desirable to cut the retrieved pipe into manageable sections.

A casing string is typically comprised of a series of joints that are 30 feet in length. The pipe joints are connected by threaded male-to-female connections. When retrieving a severed casing string during a plug and abandonment procedure, it is desirable to break the pipe string by unthreading the connected joints. However, this process is difficult where the severed string consists of outer and inner pipe strings cemented together. Further, there is little incentive to incur the time necessary to break the joints apart at the threads, as the pipe joints from an abandoned well will typically not be re-used. For these reasons, the severed casing is typically broken into smaller joints by cutting through the inner and outer strings at the surface of the well. The severed pipe sections are then recycled or otherwise disposed of.

In a conventional plug and abandonment operation, casing strings are severed generally as follows:

First, the casing string is severed within the wellbore. Typically, severance is accomplished at a depth of around 1,000 feet. Thereafter, the severed portion of casing is "jacked" out of the wellbore and raised to the surface of the rig platform using a platform-mounted elevator. As the upper end of the severed casing section reaches the floor of the platform, it is lifted to a predetermined height above a set of slips. The slips are then set, suspending the severed string of casing above the rig floor. A drilling machine then drills a hole completely through the casing, including any cement layer and smaller diameter casing which is cemented within the larger diameter casing. Thereafter, a pin or other retainer is inserted through the drilled hole to ensure that the smaller string of casing is anchored to the larger string. This method of drilling a hole through the casing and inserting a retainer pin is necessary to ensure that the smaller string of casing does not become dislodged from the larger string due to some failure of the cement layer there between.

After the inner casing string and cement therearound is anchored to the larger outer string, a band saw is used to cut the severed tubular into a predetermined length. The band saw operates with coolant to avoid the use of high temperature cutters or the production of sparks. Typically, a length of between fifteen and thirty feet is selected, with the cut being made above the retention pin. The newly severed, ten-foot portion of string is then transported to a barge or other transportation means for disposal or salvage.

With the slips disengaged, the elevator then raises the severed string of casing another length of approximately ten feet. The slips are then re-engaged and the drilling, anchoring and cutting procedure takes place again.

While the foregoing apparatus and method are adequate to dispose of strings of concentrically cemented casing, the operation necessarily requires personnel to be at the drilling mechanism and the band saw during the operation. The presence of personnel on a platform inherently carries risk. The risk is magnified when the personnel must be in close contact with the operating machinery.

There is a need, therefore, for a method and apparatus of disposing of concentric strings of tubular during a plugging and abandonment operation which does not require personnel to be located directly at the machinery performing the cutting operations. There is a further need for a method and apparatus which can be operated remotely by well platform personnel. There is yet a further need for an apparatus and method that can more safely and effectively sever strings of casing at a well site.

SUMMARY OF THE INVENTION

The present invention generally provides an apparatus and method for severing predetermined lengths of nested casing above a drilling rig or workover rig platform. The apparatus includes a clamp assembly, a drill assembly and a cutting assembly. In one aspect, the clamp assembly, the drilling assembly and the cutting assembly are disposed at the end of a telescopic arm, and are remotely operated by personnel using a control panel. In accordance with the present invention, the clamp assembly is positioned adjacent a section of casing to be severed, and then clamped thereto. Thereafter, the drilling assembly is actuated so as to drill a hole completely through the casing strings. A retention pin is then inserted through the newly formed aperture. Finally, the cutting assembly, such as a band saw, is actuated so as to severe the casing above the pin. The newly severed portion of casing above the pin may then be disposed of.

BRIEF DESCRIPTION OF THE DRAWINGS

So that the manner in which the features of the present invention are attained and can be understood in detail, a more particular description of the invention, briefly summarized above, may be had by reference to the appended drawings. It is to be noted, however, that the appended drawings illustrate only typical embodiments of this invention and are therefore not to be considered limiting of its scope, for the invention may admit to other equally effective embodiments.

FIG. 3 is a perspective view of a cross-sectional cut of a casing section. The pipe section is comprised of an outer casing string, an inner casing string and a layer of cement there between.

DETAILED DESCRIPTION OF THE PREFERRED EMBODIMENT

The present invention provides a method and apparatus for severing casing that has been removed from a wellbore.

Figure 1:
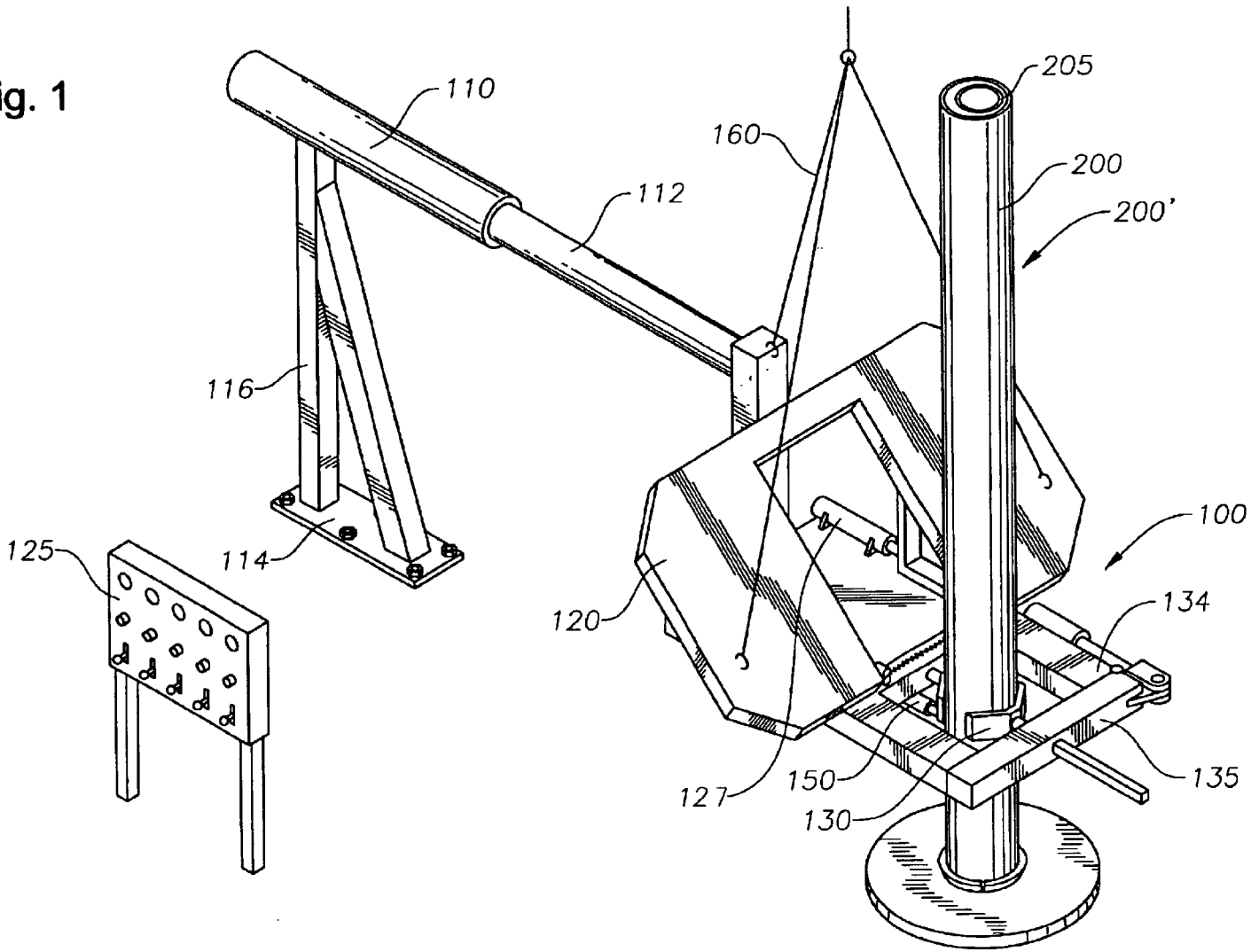
FIG. 1 is a perspective view of the tubular severing apparatus of the present invention, in one arrangement.

FIG. 1 provides a perspective view of a novel tubular cutting apparatus 100 of the present invention, in one embodiment. The apparatus 100 comprises a clamp assembly 130, a drill assembly 150 and a cutting assembly 120. The apparatus 100 is selectively movable. In one aspect, the apparatus 100 is disposed at the end of an extendable structure. In FIG. 1, the extendable structure is shown as a cantilevered arm 110. The exemplary arm 110 defines an outer barrel 110 having at least one telescoping section 112 extending therefrom. An intermediate telescoping section (not shown) may also be incorporated. In such an arrangement, the end telescoping section 112 is slidably mounted in the intermediate telescoping section which is, in turn, slidably mounted in the outer barrel 110.

The arm 110 is supported by a base 114 secured to the floor of a rig platform (not shown). The arm 110 is disposed along a vertical support beam 116 vertically extending above the base 114. In the parent application, the outer barrel of the arm 110 is described as being attached to the support beam 116 by means of a clamp (not shown in FIG. 1) bolted to the top of the beam 116. The clamp maintains the arm 110 in position with respect to the beam 116. In one aspect, the arm 110 is pivotally attached to the support beam 116 to permit the tubular severing apparatus 100 to pivot about a vertical axis and, alternatively or in addition, a horizontal axis. In one aspect, the clamp is releasably attached to the support beam 116.

Figure 4:
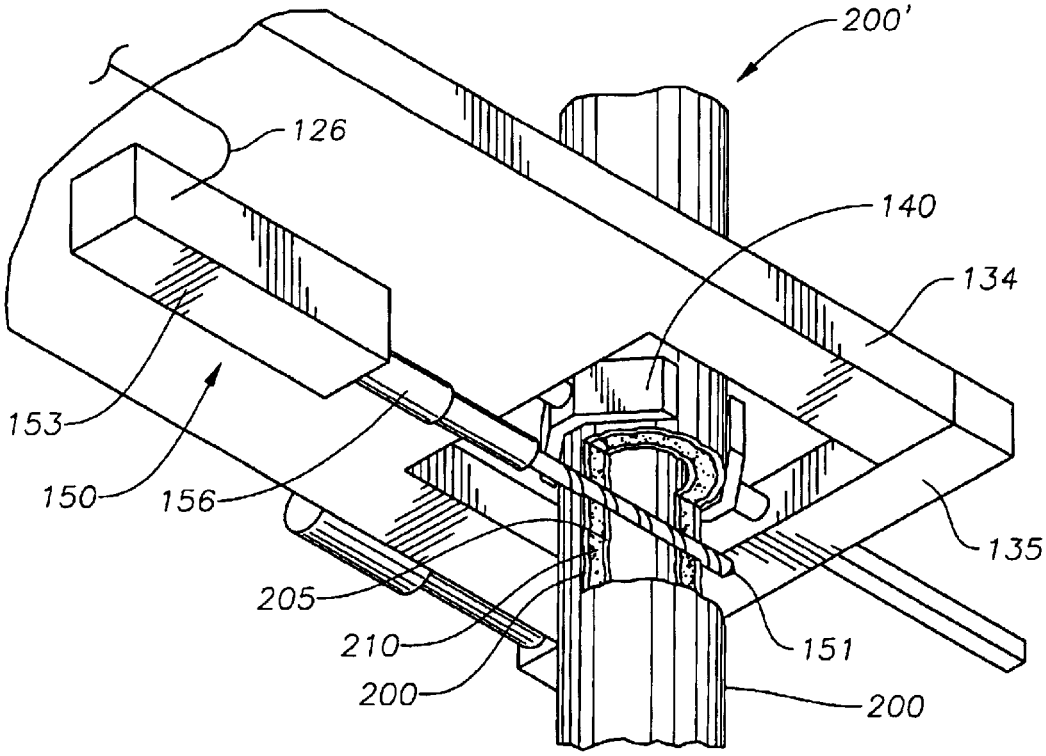
FIG. 4 is a side view illustrating a drilling assembly of the present invention. The drilling assembly is shown drilling a hole through a casing section.

An additional feature of the arm 110 described more fully in the parent application is that the outer barrel 110 of the arm itself may be selectively moved with respect to the support beam 116. This means that the entire arm 110 may be retracted away from the casing section 200'. When the telescoping sections 112 are fully contracted, the free end of the arm 110 lies closely adjacent the support beam 116. This retracting feature is shown in FIG. 4 of the parent application with respect to a tong, but may also be employed in the present application with respect to a tubular severing assembly 100.

In the arrangement of FIG. 1, the apparatus 100 is further supported by an overhead hoisting system. Cables 160 from the hoisting system are visible in FIG. 1. In one aspect, the hoisting system maneuvers the tubular severing apparatus 100, with the telescoping section 112 of the arm 110 moving in response. In another aspect, the telescoping section 112 of the arm 110 is hydraulically powered, causing the apparatus 100 and the supporting cables 160 to advance and recede in response to movement of the arm 110. Alternatively, the arm 110 and the hoisting system may be independently powered.

Further details concerning the operation of a suitable telescoping arm are found in the pending application entitled "Apparatus for Positioning a Tong", Ser. No. 09/355,439, and was filed on Nov. 29, 1999, now U.S. Pat. No. 6,412, 553. That application is incorporated by reference herein, in its entirety.

Also visible in FIG. 1 is a section of casing 200'. Casing section 200' represents an upper, severed string of casing that is being retrieved from a wellbore (not shown in FIG. 1). The casing 200' is being further severed into smaller portions for ease of manipulation and disposal. The exemplary casing string 200' houses a smaller, inner string of casing 205 nested within an outer casing string 200. The inner string 205 has been cemented into the outer string 200 in connection with earlier wellbore completion operations.

Figure 2:
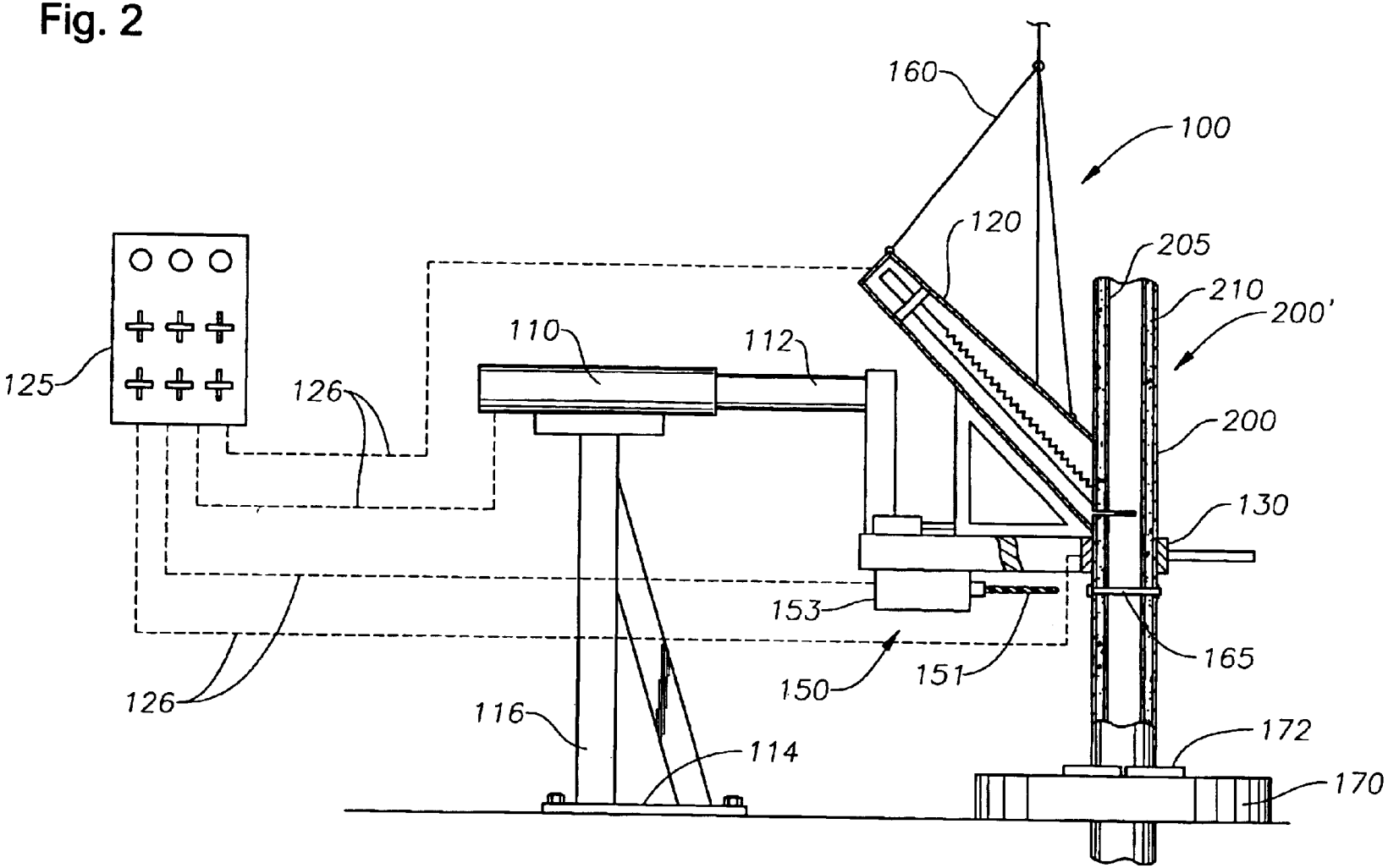
FIG. 2 is a side, schematic view of the tubular severing apparatus of FIG. 1.

FIG. 2 is a schematic view of the apparatus 100, adjacent a section of casing 200'. Visible again in FIG. 2 is the clamp assembly 130, the drill assembly 150 and the cutting assembly 120. In this arrangement, the assembly 100 is again disposed at the distal end of the telescopic arm 110 and is suspended from above with cables 160. The telescopic arm 110 again has at least one telescoping section 112.

In FIG. 2, the clamp assembly 130 is radially disposed about the section of casing 200' so as to secure the casing section 200' for severing. The casing 200' is shown in FIG. 2 in cross-section. Visible in this view are the outer casing string 200, the inner casing string 205 and a matrix of cured cement 210 in the annular region between the two casing strings 200, 205.

Figure 3:
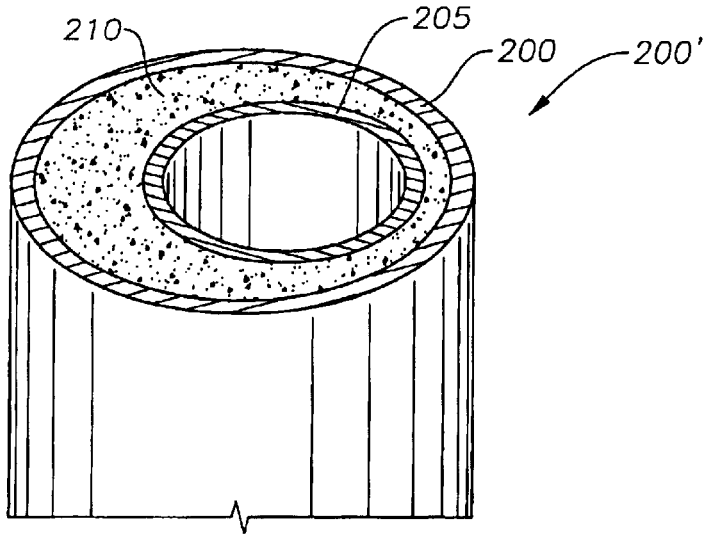

FIG. 3 is a perspective view showing a cross-section of the casing 200' after it has been severed using the apparatus 100 of FIG. 2. As previously described, casing section 200' defines an outer string of casing 200 which houses a smaller diameter casing 205. A matrix of cement 210 is disposed in an annular area between the two casing strings 200, 205. In this view, inner casing string 205 is eccentric relative to the surrounding outer casing string 200, as is typical in a completed wellbore.

Referring back to FIG. 2, the tubular string 200' is shown being held above a floor member 170 by a set of slips 172. The slips 172 permit the tubular string 200' to be raised from below the surface of the platform to some height. Typically, elevators (not shown) are provided on a rig for maneuvering pipe relative to the wellbore. The slips 172 hold the casing 200' so that it can be clamped and severed by the apparatus 100 after positioning of the casing 200' by the elevators.

As noted, the apparatus 100 includes a drill assembly 150. The purpose of the drill assembly 150 is to form an aperture through the casing strings 200, 205 for insertion of a retention member 165. Preferably, the retention member 165 defines a pin configured to be received within the formed aperture. Various pin types may be used, including, for example, a cylindrical bar, a cotter pin, or a cotter and key. In FIG. 2, a simple tubular pin is shown. The pin 165 serves to anchor any nested casing string 205 and cement 210 to the outer casing string 200. Preferably, the aperture is formed completely through both the front and back walls of the outer casing string 200, and the pin 165 is inserted completely through the outer casing string 200.

In the arrangement of FIG. 2, the drill assembly 150 is disposed below the band saw 120. The drill assembly 150 is constructed and arranged to insert a rotating drill bit 151 essentially perpendicular to the longitudinal axis of the casing string 200'. In this way, a suitable aperture is formed. Any known drilling device may be employed for boring a through-opening into the casing section 200'. The drill assembly 150 of FIG. 2 utilizes a rotary motor (not shown) inside of a housing 153 to rotate a single drill bit 151. A positioning device is further provided for selectively advancing the drill bit 151 towards and away from the casing section 200. In one aspect, a hydraulic cylinder 156 is used to advance the drill bit 151 towards and away from the casing section 200' by adjusting flow and pressure of hydraulic fluid.

An enlarged perspective view of a drill assembly 150 in operation is shown in FIG. 4. The drill bit 151 can be more clearly seen penetrating the wall of the outer section of casing 200. The drill assembly 150 typically operates with a source of coolant and advances forward towards the casing 200 by means of a telescoping positioning device, shown in FIG. 4 as a cylinder 156. In one aspect, the drill assembly 150 is operated remotely from a control panel 125 as is shown in FIG. 2. The remote control panel 125 will be more fully described, infra.

Figure 5A:
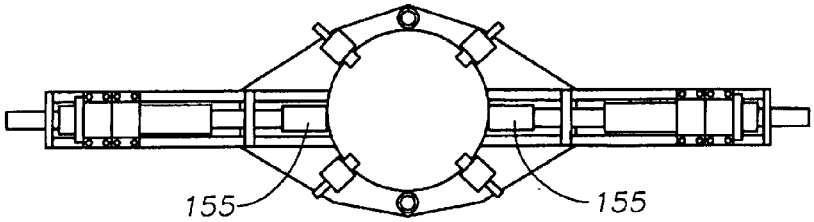
FIG. 5*a* is a top view showing an alternate embodiment of a drill assembly of the present invention.
Figure 5B:
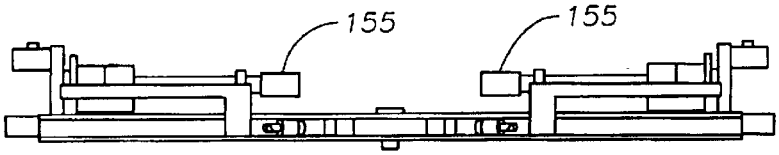
FIG. 5*b* presents a side view illustrating the drill assembly of FIG. 5*a*.

An alternative arrangement for a drill assembly is presented in FIGS. 5*a* and 5*b*. FIG. 5*a* is a top view of an alternate embodiment of a drilling assembly for the present invention. FIG. 5*b* is a side view thereof. In this arrangement, a pair of opposing boring devices 155 are urged inwardly towards the center of the casing section 200'. Again, it is within the spirit of the present invention to employ any drilling assembly 150 capable of boring an aperture through the casing section 200' for insertion of an anchoring pin 165.

Referring again to FIG. 2, it can be seen that the drill assembly 150 has been actuated to form an aperture through both casings strings 200, 205. The pin 165 has been inserted through the formed aperture to anchor the inner casing 205 to the outer casing 200.

Figure 6:
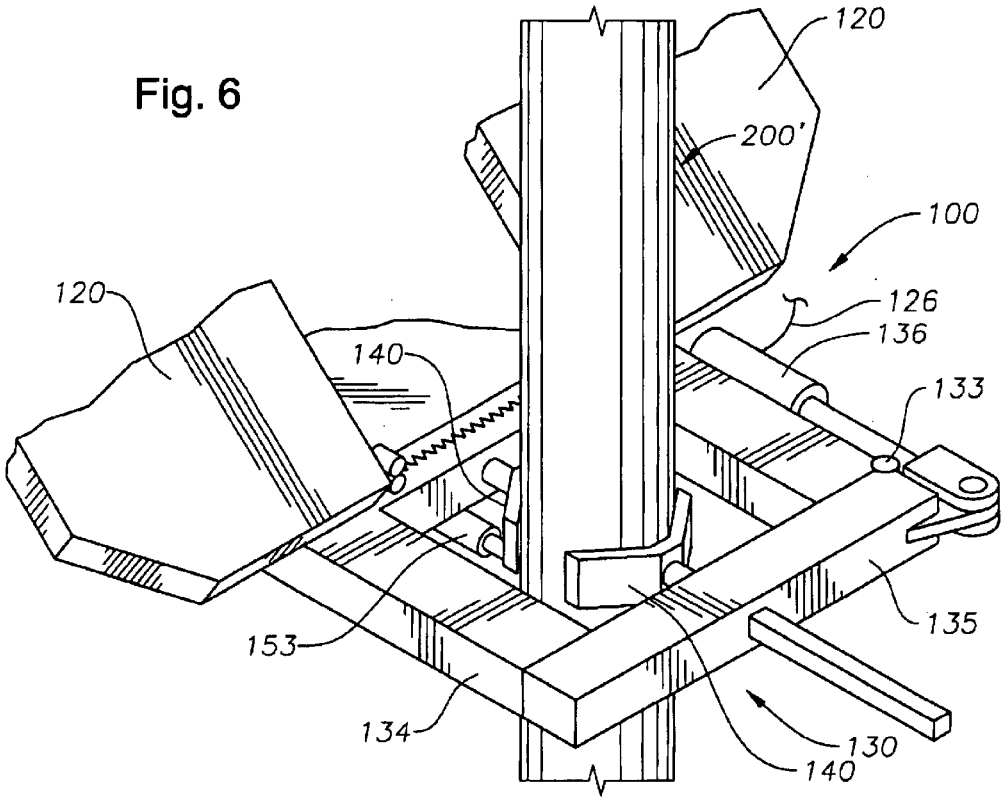
FIG. 6 is a perspective view illustrating the tubular severing apparatus of FIG. 1. In this view, the clamping assembly is more clearly seen. The clamping assembly is shown clamping a casing section. Also visible is the band saw being used to cut through the casing section.

FIG. 6 is a perspective view of the apparatus 100 of FIG. 1. In this view, the clamp assembly 130 is more clearly seen. The clamp assembly 130 includes a frame 134 that selectively radially encompasses the casing section 200' in order to secure the apparatus 100 to the casing section 200'. The clamp assembly 130 further comprises at least two clamp members 140 for frictionally engaging the casing 200'. In the arrangement of FIG. 6, the clamp members 140 each define a pair of angled support blocks which are moved into contact with the casing 200'. However, other arrangements may be employed, such as a single block having a concave surface.

The clamp assembly 130 includes a gate member 135 that swivels about a hinge 133 mounted on the frame 134. The hinge 133 permits the gate member 135 to be selectively opened and closed for receiving and for clamping the casing 200'. In the view of FIG. 6, the gate member 135 is closed about the casing 200' while the casing section 200' is being severed. The gate member 135 includes at least one clamp member 140 for engaging the casing 200' in its closed position. The gate 135 preferably operated with hydraulic power, and is remotely operated from control panel 125. A hydraulic arm 136 is shown to aid in remotely opening and closing the gate 135.

Figure 7:
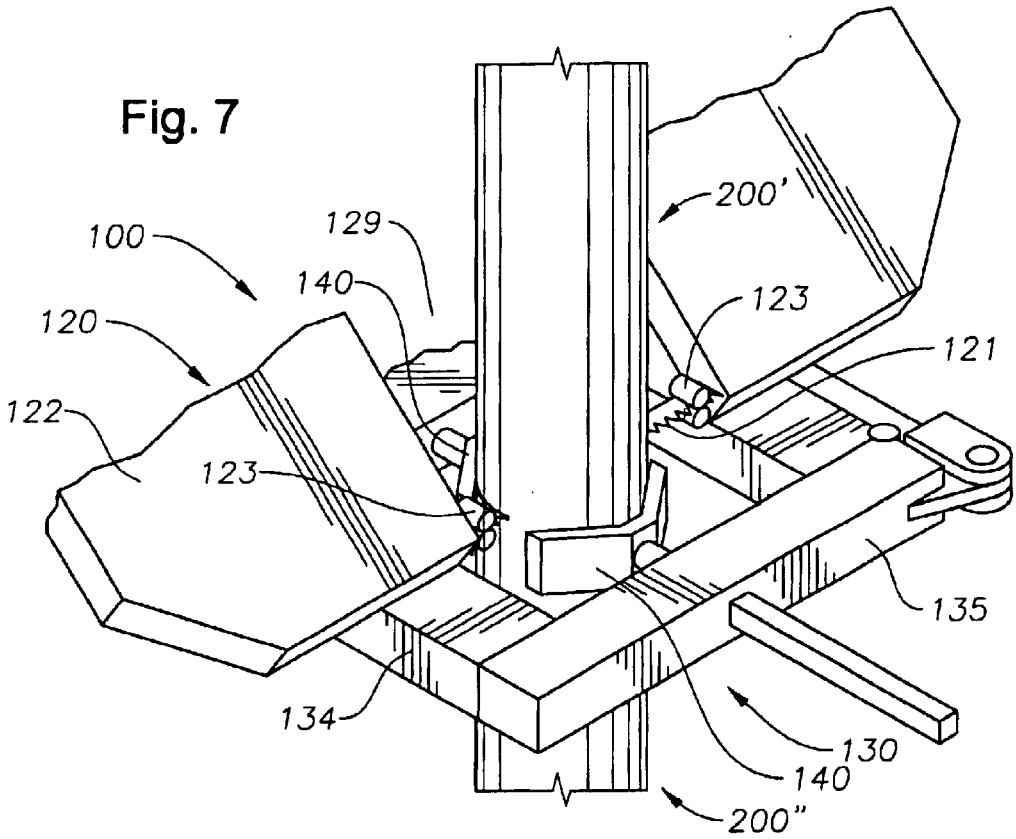
FIG. 7 is also a perspective view illustrating the tubular severing apparatus of FIG. 1. In this view, features of an exemplary band saw are more clearly. The band saw is again shown cutting a casing section.
Figure 8:
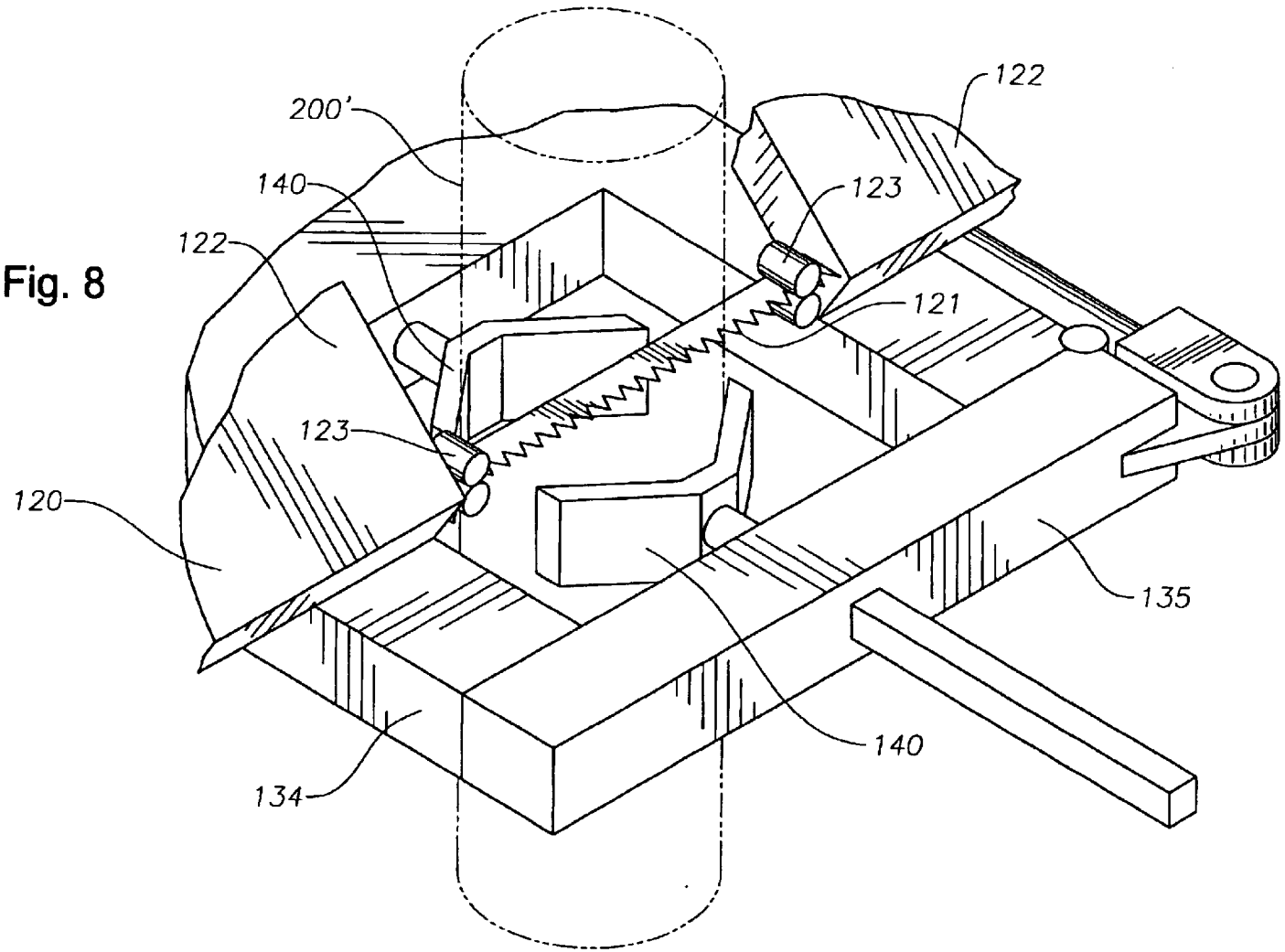
FIG. 8 is an enlarged view of the band saw of FIG. 7.

FIG. 7 presents the apparatus 100 of FIG. 1 in still greater detail. In this perspective view, the cutting assembly 120 is more clearly seen. The cutting assembly 120 is shown as a band saw. The band saw 120 first comprises a housing 122. The housing 122 houses a pair of wheels (not seen in FIG. 7) about which a band saw blade 121 is tracked. The band saw blade 121 includes a plurality of teeth. The blade 121 is fed through pairs of roller members 123 which guide the blade 121 to cut in a direction substantially perpendicular to the longitudinal axis of the outer casing 200. One pair of roller members 123 is preferably provided at the housing outlet for the blade 121. In this respect, the blade 121 is fed through this first pair of roller members 123. A second pair of roller members 123 is disposed at the opening in the housing 122 through which the blade 121 is received back into the housing 122. The roller members 123 are more clearly seen in the enlarged view of FIG. 8.

It is within the spirit of the present invention to utilize any cutting device 120 known for severing casing, so long as the cutting device 120 may be adapted to operate in conjunction with a clamp assembly 130 and a drill assembly 150. In the exemplary arrangement for a cutting assembly 120 of FIG. 7, the cutting assembly defines a band saw 120. Further, the band saw 120 includes a housing 122 that is offset from the angle of cutting by the blade 121. In other words, the angle of the housing 122 of the band saw 120 is offset from the angle at which the teeth of the blade 121 engage the outer casing 200 during the cutting operation. The angle shown is approximately 30 degrees, though other angles may be used. In addition, an enlarged spacing 129 is provided in the housing 122 between the wheels. These features accommodate placement of and access to the drill assembly 150 and clamp assembly 130. The spacing 129 in the housing 122 is more importantly sized to receive the casing 200' as the blade 121 of the saw 120 advances through the casing 200' during a cutting operation In the drawings of FIG. 7 and FIG. 8, the blade 121 of the band saw 120 has been actuated. In addition, the blade 121 is engaging the casing section 200', and has advanced partway through the casing 200' to form a cut that is substantially perpendicular to the longitudinal axis of the outer casing 200.

Figure 9:
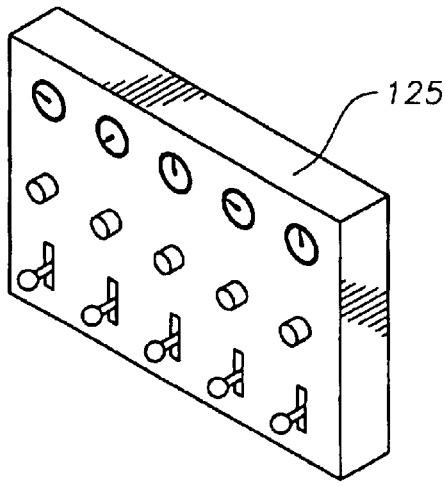
FIG. 9 is a perspective view of a control panel as might be used to control various portions of the severing apparatus of the present invention.

Referring again to FIG. 2, the band saw 120, the clamp assembly 130, and the drill assembly 150 are preferably controlled in an automated fashion from a control panel 125. Control lines 126 are provided from the control panel 125 to control the assembly 100, e.g., parts 120, 130, 150, etc. FIG. 9 is a more detailed perspective view showing a typical control panel 125 to be utilized with a tubular severing apparatus 100. The illustrated control panel 125 in one aspect includes separate controls to operate the clamp assembly 130, the drilling assembly 150, and the band saw 120.

The band saw 120 and the drill assembly 150 are typically operated with similar controls. For example, the drill assembly 150 and saw 120 each require an on/off control and a rotational speed control to manipulate the rotation of the saw blade 121 or the drill bit 151. Corresponding gauges illustrating the rotational movement of the drill bit 151 and the band saw 121 as shown in revolutions per minute may optionally be provided. In addition, a tool advancing control is provided to control the speed of advance of the drill bit 151 into the casing 200' and the blade 121 of the band saw 120 into the casing 200'. Corresponding positioning devices 127 (shown in FIG. 1) and 156 (shown in FIG. 4) are provided for the band saw 121 and the drill assembly 150. These positioning devices, 126, 156, in one aspect, represent telescoping hydraulic cylinders. These devices permit the drill bit 151 of the drill assembly 150 and the blade 121 of the band saw 120 to be independently, selectively advanced towards the casing 200' during the respective drilling and cutting operations and then withdrawn.

In addition, both the band saw 120 and the drill assembly 150 optionally include pressure sensors to determine the amount of pressure placed upon the casing by the rotating drill bit 151 or the rotating saw blade 121. Gauges may be provided at the control panel 125 indicating pressures on the drill bit 151 or the rotating saw blade 121. For example, core heads and saw blades provided by Mirage Tool Co ltd. (U.K.) and core heads from Alf I Larsen (Norway) may be used.

The clamp assembly 130 also has controls that are located on the control panel 125. For instance, the clamp assembly 130 includes a panel-mounted control which opens and closes the gate 135 located on the clamp assembly 130. Optionally, a gauge indicating pressure between the casing 200' and a clamp 140 may be provided and pressure of the clamps 140. A corresponding sensor is positioned on at least one of the clamp members 140 for sensing pressure of the clamp member 140 against the casing 200 when the gate 135 is closed. Preferably, the sensor is placed on the clamp member 140 on the gate 135.

In use, the severing apparatus of the present invention operates as follows:

First, a casing cutting means (not shown) is run into a wellbore. The cutting means is typically disposed on the end of a run-in string or wireline. The cutting means is placed in the wellbore at a predetermined depth, and then actuated. In this way, a selected length of casing is severed downhole. Thereafter, the severed portion of casing 200 is pulled or "jacked out" of the wellbore and lifted to the rig platform within an elevator.

A predetermined amount of the severed portion of casing 200' is pulled upwards past the slip 172 located at the level of the platform floor. The casing 200' is held in place by the slip 172, exposing the upper portion of the casing 200' above the platform floor. Thereafter, a tubular severing apparatus 100 of the present invention is moved towards the casing 200' by the telescopic arm assembly 110 with its extending and retracting sections 112. As the apparatus 100 reaches a location proximate to the casing 200', the clamp assembly 130 is actuated to open the gate 135 and to receive the casing 200'. The gate 135 is then closed around the casing 200', and the clamp assembly 130 is secured to the casing 200' by the clamping members 140. In this way, the severing apparatus 100 is properly positioned with respect to the casing 200'.

Thereafter, with the outer casing string 200 clamped in the apparatus 100, the drill assembly 150 is operated. Preferably, remote actuation of the drill assembly 150 is conducted through the control panel 125. The drill bit 151 disposed on the drill assembly 150 is rotated and advanced towards the casing 200 to form an aperture therein. The aperture is created through at least the front wall of the casing section 200' at an angle substantially perpendicular to the longitudinal axis of the outer casing 200. A retention mechanism such as a pin 165 is then inserted through the casing 200' to ensure that any inner string of casing 205 is longitudinally fixed with respect to the outer string of casing 200.

The next step involves actuation of the band saw 120. Preferably, actuation of the band saw 120 is performed remotely via the control panel 125. The blade 121 of the band saw 120 is actuated, and is advanced through the casing 200' at a point above the pin 165. The retention pin 165 anchors the smaller diameter casing 205 within the larger diameter casing 200. In this manner, the inner 205 and outer 200 casing strings in the lower section 200" are prevented from separating below the rig floor. The severed portion of the casing section 200' is then lifted away, leaving an upper end of the lower portion of casing 200" remaining within the clamping assembly 130.

Once the severed piece of casing 200' has been disposed of, an elevator or other lifting device works with the slips to lift the casing 200' another predetermined distance upwards. The slips 172 are then used to re-grasp the casing 200' for the operation to be repeated. Each time a severing operation is completed, the clamp assembly 130 is de-activated, and the gate 135 is reopened so that the apparatus 100 can move away from the severed piece of casing 200'. In addition, it is noted that the pin 165 may be retained in the newly lifted section of casing 200' to be severed. A new pin 165 can then be inserted once a new aperture is formed within the casing 200'.

As demonstrated in the foregoing disclosure, the apparatus 100 of the present invention provides a safe and efficient means for severing casing during a plug and abandonment operation. In one aspect, the apparatus 100 is operated via a remotely located control panel 125.

While the foregoing is directed to embodiments of the present invention, other and further embodiments of the invention may be devised without departing from the basic scope thereof, and the scope thereof is determined by the claims that follow.

What is claimed is:

1. An apparatus for severing casing above a wellbore, the apparatus comprising:

a clamp assembly, the clamp assembly constructed and arranged to frictionally enpace the casing and hold the casing in relation to the apparatus, wherein the pressure applied against the casing by the clamp assembly is adjustable;

a drill assembly, the drill assembly constructed and arranged to form an aperture through the casing and through any inner casing string nested within the casing, the aperture being dimensioned to receive a retention member for anchoring the casing to the any nested casing string; and a cutting assembly, the cutting assembly constructed and arranged to sever the casing and the any other nested casing string by forming a through-cut through the casing.

2. The apparatus of claim 1, wherein the clamp assembly comprises: at least two clamp members for engaging the casing; a gate movable on a hinge for selectively opening and closing the gate, the gate having at least one clamp member disposed thereon.

3. The apparatus of claim 2, wherein each clamp member defines a pair of angled support blocks.

4. The apparatus of claim 3, wherein the gate for the clamp assembly is remotely operable.

5. The apparatus of claim 2, wherein the clamp assembly further comprises a sensor on one of the at least two clamp members for sensing pressure of the clamp member against the casing when the gate is closed.

6. An apparatus for severing casing above a welibore, the apparatus comprising:

a clamp assembly for holding the casing in relation to the apparatus, the clamp assembly comprising:

a frame;

at least two clamp members for frictionally engaging the casing;

a hinge mounted on the frame; and a gate movable on the hinge for selectively opening and closing the clamp assembly, the gate having at least one clamp member disposed thereon;

a drill assembly for forming an aperture through the casing and through any other nested casing string within the casing, the aperture being dimensioned to receive a retention member for anchoring the casing to the any other nested casing string, the drill assembly comprising:

a drill bit for boring the aperture;

a rotary motor for rotating the drill bit; and a positioning device for advancing the position of the drill bit through the casing during the drilling operation after the casing has been clamped by the clamp assembly;

a band saw for severing the casing and the any nested casing string into manageable lengths by forming a through-cut through the casing, the band saw comprising:

a blade having a plurality of teeth;

at least two wheels about which the blade is tracked;

a housing for the at least two wheels, the housing having a first opening through which the blade exits the housing, and a second opening through which the blade re-enters the housing;

a first pair of roller members disposed at the first opening of the housing through which the blade is fed, and a second pair of roller members disposed at the second opening of the housing through which the blade is received, the first and second pairs of roller members guiding the blade to cut the casing at an angle substantially perpendicular to the longitudinal axis of the casing; and a positioning device for advancing the position of the blade through the casing during the cutting operation after the casing has been clamped by the clamp assembly.

7. The apparatus of claim 6, wherein each clamp member defines a pair of angled support blocks.

8. The apparatus of claim 6:

wherein the angle of the housing of the band saw is offset from the angle at which the teeth of the blade engage the casing during the cutting operation; and wherein the housing of the band saw comprises an enlarged spacing between the wheels, the spacing being sized to receive the casing as the blade of the saw advances through the casing during a cutting operation.

9. The apparatus of claim 6, wherein:

the clamp assembly further comprises a sensor on one of the at least two clamp members for sensing pressure of the clamp member against the casing when the gate is closed;

the drill assembly further comprises a sensor for sensing pressure between the at least one drill bit and the engaged casing during the boring procedure, and a sensor for sensing rotational movement of the at least one drill bit in revolutions per minute; and the band saw further comprises a sensor for sensing pressure between the blade and the engaged casing during the cutting procedure.

10. The apparatus of claim 6, wherein:

the gate for the clamp assembly is remotely operable;

the positioning device for the drill bit of drill assembly is remotely operable; and the positioning device for the blade of the saw is remotely operable.

11. The apparatus of claim 10, further comprising a telescoping arm for selectively advancing the apparatus towards and away from the casing, the apparatus being disposed proximate to an end of the arm.

12. A method of severing casing, comprising the steps of:

clamping an apparatus to casing;

forming an aperture through the casing and through any inner casing string nested therein, using a drill assembly in the apparatus;

anchoring the casing and the any nested casing string together; and severing the casing using a cutting assembly in the apparatus, the cutting assembly comprising a blade to form a cut.

13. A method of severing casing, comprising the steps of:

clamping a casing severing apparatus to a section of casing, the casing severing apparatus comprising:

a clamp assembly, the clamp assembly constructed and arranged to hold the casing in relation to the apparatus;

a drill assembly having at least one drill bit and a rotary motor to rotate the at least one drill bit, the drill assembly constructed and arranged to form an aperture through the casing and through any casing string nested within the casing, the aperture being dimensioned to receive a retention member for anchoring the casing to the any nested casing string;

a saw, the saw constructed and arranged to sever the casing and the any nested casing string by forming a through-cut through the casing;

a positioning device for advancing the position of the drill bit through the casing during the drilling operation, after the casino has been clamped by the clamp assembly;

actuating the drill assembly to form the aperture through the casing and through any casing string nested within the casing;

inserting a pin through the aperture to secure the any nested casing string within the casing; and actuating the saw to form a through-cut through the casing above the pin.

14. The method of severing casing of claim 13, wherein the clamp assembly comprises:

at least two clamp members for frictionally engaging the casing; and a gate movable on a hinge for selectively opening and closing the gate, the gate having at least one clamp member disposed thereon.

15. The method of severing casing of claim 14, wherein each clamp member defines a pair of angled support blocks.

16. The method of severing casing of claim 15, wherein the gate for the clamp assembly is remotely operable.

17. The method of severing casing of claim 13, wherein the clamp assembly further comprises a sensor on one of the at least two clamp members for sensing pressure of the clamp member against the casing when the gate is closed.

18. The method of severing casing of claim 13, wherein the positioning device for the drill bit of drill assembly is remotely operable.

19. The method of severing casing of claim 13, wherein the drill assembly further comprises:

a sensor for sensing pressure between the at least one drill bit and the engaged casing during the boring procedure; and a sensor for sensing rotational movement of the at least one drill bit in revolutions per minute.

20. The method of severing casing of claim 13, wherein the saw defines a band saw comprising:

a blade having a plurality of teeth;

at least two wheels about which the blade is tracked; and a housing for the at least two wheels, the housing having a first opening through which the blade exits the housing, and a second opening through which the blade re-enters the housing.

21. The method of severing casing of claim 20, wherein the band saw further comprises:

a first pair of roller members disposed at the first opening of the housing through which the blade is fed; and a second pair of roller members disposed at the second opening of the housing through which the blade is received;

the first and second pairs of roller members guiding the blade to cut the casing at an angle substantially perpendicular to the longitudinal axis of the casing.

22. The method of severing casing of claim 21, further comprising a positioning device for advancing the position of the blade through the casing during the cutting operation, after the casing has been clamped by the clamp assembly.

23. The method of severing casing of claim 22, wherein the angle of the housing of the band saw is offset from the angle at which the teeth of the blade engage the casing during the cutting operation.

24. The method of severing casing of claim 23, wherein the housing of the band saw comprises an enlarged spacing between the wheels, the spacing being sized to receive the casing as the blade of the saw advances through the casing during a cutting operation.

25. The method of severing casing of claim 24, wherein the positioning device for the blade of the saw is remotely operable.

26. A method of severing casing, comprising the steps of:

clamping a casing severing apparatus to a section of casing, the casing severing apparatus comprising:

a clamp assembly for holding the casing in relation to the apparatus the clamp assembly comprising:

a frame;

at least two clamp members for frictionally engaging the casing;

a hinge mounted on the frame; and a gate movable on the hinge for selectively opening and closing the clamp assembly, the gate having at least one clamp member disposed thereon;

a drill assembly for forming an aperture through the casing and through any other nested casing string within the casing, the aperture being dimensioned to receive a pin for anchoring the casing to the any other nested casing string, the drill assembly comprising:

a drill bit for boring the aperture;

a rotary motor for rotating the drill bit; and a positioning device for advancing the position of the drill bit through the casing during the drilling operation after the casing has been clamped by the clamp assembly;

a band saw for severing the casing and the any nested casing string into manageable lengths by forming a through-cut through the casing, the band saw comprising:

a blade having a plurality of teeth;

at least two wheels about which the blade is tracked;

a housing for the at least two wheels, the housing having a first opening through which the blade exits the housing, and a second opening through which the blade re-enters the housing;

a first pair of roller members disposed at the first opening of the housing through which the blade is fed, and a second pair of roller members disposed at the second opening of the housing through which the blade is received, the first and second pairs of roller members guiding the blade to cut the casing at an angle substantially perpendicular to the longitudinal axis of the casing;

a positioning device for advancing the position of the blade through the casing during the cutting operation after the casing has been clamped by the clamp assembly;

actuating the drill assembly to form the aperture through the casing and through the any casing string nested within the casing;

inserting a pin through the aperture to secure the any nested casing string within the casing; and actuating the band saw to form a through-cut through the casing above the pin.

27. The method of severing casing of claim 26, wherein each clamp member defines a pair of angled support blocks.

28. The method of severing casing of claim 26:

wherein the angle of the housing of the band saw is offset from the angle at which the teeth of the blade engage the casing during the cutting operation; and wherein the housing of the band saw comprises an enlarged spacing between the wheels, the spacing being sized to receive the casing as the blade of the saw advances through the casing during a cutting operation.

29. The method of severing casing of claim 26, wherein:

the clamp assembly further comprises a sensor on one of the at least two clamp members for sensing pressure of the clamp member against the casing when the gate is closed.

30. The method of severing casing of claim 26, wherein:

the gate for the clamp assembly is remotely operable;

the positioning device for the drill bit of drill assembly is remotely operable; and the positioning device for the blade of the saw is remotely operable.

31. The method of severing casing of claim 30, wherein:

the casing severing apparatus is disposed proximate to an end of a telescoping arm for selectively advancing the apparatus towards and withdrawing the apparatus away from the casing.

32. A method for pulling concentric tubulars from an earth welibore, the method comprising the steps of:

pulling the concentric tubulars upward from the earth wellbore in order to expose a first section of the concentric tubulars above the wellbore;

coupling the first section of concentric tubulars by forming an aperture through the concentric tubulars and inserting a retention member therethough so that they are not axially movable with respect to one another;

clamping the concentric tubulars below a point of severance in order to provide axial support of the concentric tubulars; and severing the concentric tubulars at a location above the point of coupling.

33. The method of claim 32, wherein the retention member defines a pin.

34. The method of claim 33, wherein the pin defines a cylindrical bar.

35. The method of claim 33, wherein the pin defines a cotter pin.

36. The method of claim 33, wherein the pin defines a cotter and key.

37. The method of claim 32, further comprising the step of:

pulling the concentric tubulars upward from the earth wellbore in order to expose a second section of the concentric tubulars above the wellbore after the first section of the concentric tubulars is severed.

38. The method of claim 32, wherein the severing step is performed by using a cutting assembly, the cutting assembly constructed and arranged to sever the concentric tubulars by forming a through-cut through the casing.

39. The method of claim 38, wherein the clamping step is performed by using a clamp assembly, the clamp assembly comprising:

at least two clamp members for engaging an outer tubular string of the concentric tubulars; and a gate movable on a hinge for selectively opening and closing the gate, the gate having at least one clamp member disposed thereon.

40. The method of claim 7, wherein the each clamp member defines a pair of angled support blocks.

41. The method of claim 40, wherein the gate for the clamp assembly is remotely operable.

42. The method of claim 41, wherein the clamp assembly further comprises a sensor on one of the at least two clamp members for sensing pressure of the clamp member against the outer tubular string of the concentric tubulars when the gate is closed.

43. The method of claim 32, wherein the aperture is formed by using a drill assembly, the drill assembly comprising:

at least one drill bit for boring the aperture; and a rotary motor for rotating the at least one drill bit.

44. The method of claim 43, further comprising a positioning device for advancing the position of the drill bit through the concentric tubulars during the drilling operation, after the outer tubular string has been clamped by the clamp assembly.

45. The method of claim 44, wherein the positioning device for the drill bit of drill assembly is remotely operable.

46. The method of claim 43, wherein the drill assembly further comprises:

a sensor for sensing pressure between the at least one drill bit and the engaged concentric tubulars during the boring procedure; and a sensor for sensing rotational movement of the at least one drill bit in revolutions per minute.

47. The method of claim 38, wherein the cutting assembly defines a band saw comprising:

a blade having a plurality of teeth;

at least two wheels about which the blade is tracked; and a housing for the at least two wheels, the housing having a first opening through which the blade exits the housing, and a second opening through which the blade re-enters the housing.

48. The method of claim 47, wherein the band saw further comprises:

a first pair of roller members disposed at the first opening of the housing through which the blade is fed; and a second pair of roller members disposed at the second opening of the housing through which the blade is received;

the first and second pairs of roller members guiding the blade to cut the casing at an angle substantially perpendicular to the longitudinal axis of the casing.

49. The method of claim 48, wherein the band saw further comprises a positioning device for advancing the position of the blade through the casing during the cutting operation after the casing has been clamped by the clamp assembly.

50. The method of claim 49, wherein the angle of the housing of the band saw is offset from the angle at which the teeth of the blade engage the casing during the cutting operation.

51. The apparatus of claim 49, wherein the positioning device for the blade of the saw is remotely operable.

52. An apparatus for severing casing above a welibore, the apparatus comprising:

a clamp assembly, the clamp assembly constructed and arranged to hold the casing in relation to the apparatus;

a drill assembly constructed and arranged to form an aperture through the casing and through any inner casing string nested within the casing, the aperture being dimensioned to receive a retention member for anchoring the casing to the any nested casing string, wherein the drill assembly includes at least one drill bit and a rotary motor to rotate the at least one drill bit;

a cutting assembly, the cutting assembly constructed and arranged to sever the casing and the any other nested casing string by forming a through-cut through the casing; and a positioning device for advancing the position of the drill bit through the casing during the drilling operation, after the casing has been clamped by the clamp assembly.

53. The apparatus of claim 52, wherein the positioning device for the drill bit of drill assembly is remotely operable.

54. The apparatus of claim 52, wherein the drill assembly further comprises:

a sensor for sensing pressure between the at least one drill bit and the engaged casing during the boring procedure; and a sensor for sensing rotational movement of the at least one drill bit in revolutions per minute.

55. An apparatus for severing casing above a wellbore, the apparatus comprising:

a clamp assembly, the clamp assembly constructed and arranged to hold the casing in relation to the apparatus;

a drill assembly, the drill assembly constructed and arranged to form an aperture through the casing and through any inner casing string nested within the casing, the aperture being dimensioned to receive a retention member for anchoring the casing to the any nested casing string; and a cutting assembly, the cutting assembly constructed and arranged to sever the casing and the any other nested casing string by forming a through-cut through the casing, wherein the cutting assembly defines a band saw comprising:

a blade having a plurality of teeth;

at least two wheels about which the blade is tracked; and a housing for the at least two wheels, the housing having a first opening through which the blade exits the housing.

56. The apparatus of claim 55, wherein the band saw further comprises:

a first pair of roller members disposed at the first opening of the housing through which the blade is fed; and a second pair of roller members disposed at the second opening of the housing through which the blade is received;

the first and second pairs of roller members guiding the blade to cut the casing at an angle substantially perpendicular to the longitudinal axis of the casing.

57. The apparatus of claim 56, further comprising a positioning device for advancing the position of the blade through the casing during the cutting operation after the casing has been clamped by the clamp assembly.

58. The apparatus of claim 57, wherein the angle of the housing of the band saw is offset from the angle at which the teeth of the blade engage the casing during the cutting operation.

59. The apparatus of claim 58, wherein the housing of the band saw comprises an enlarged spacing between the wheels, the spacing being sized to receive the casing as the blade of the saw advances through the casing during a cutting operation.

60. The apparatus of claim 59, wherein the positioning device for the blade of the saw is remotely operable.

* * * * *